US011566850B2

(12) United States Patent
Andersson

(10) Patent No.: US 11,566,850 B2
(45) Date of Patent: Jan. 31, 2023

(54) HEAT EXCHANGING PLATE WITH VARYING PITCH

(71) Applicant: SWEP International AB, Landskrona (SE)

(72) Inventor: Sven Andersson, Hässleholm (SE)

(73) Assignee: SWEP International AB, Karlskrona (SE)

( * ) Notice: Subject to any disclaimer, the term of this patent is extended or adjusted under 35 U.S.C. 154(b) by 26 days.

(21) Appl. No.: 17/004,632

(22) Filed: Aug. 27, 2020

(65) Prior Publication Data

US 2021/0048253 A1 Feb. 18, 2021

Related U.S. Application Data

(63) Continuation of application No. 15/101,568, filed as application No. PCT/EP2014/075957 on Nov. 28, 2014, now Pat. No. 10,775,108.

(30) Foreign Application Priority Data

Dec. 5, 2013 (SE) ..... 1351451-8

(51) Int. Cl.
*F28D 9/00* (2006.01)
*F28F 3/04* (2006.01)
*F28F 13/12* (2006.01)

(52) U.S. Cl.
CPC ..... *F28D 9/005* (2013.01); *F28F 3/042* (2013.01); *F28F 3/046* (2013.01); *F28F 13/12* (2013.01); *F28F 2215/04* (2013.01)

(58) Field of Classification Search
CPC . F28D 9/005; F28F 3/042; F28F 3/046; F28F 13/12
See application file for complete search history.

(56) References Cited

U.S. PATENT DOCUMENTS 5,126,919 A 6/1992 Yamamoto
6,180,846 B1 1/2001 Dandekar
(Continued)

FOREIGN PATENT DOCUMENTS

CN 102084204 A 6/2011
EP 0204880 A2 12/1986
(Continued)

OTHER PUBLICATIONS

Hitoshi Iijima, Plate type heat exchanger and refrigeration cycle device using the same, 2009, Full Document (Year: 2009).*
(Continued)

*Primary Examiner* — Nael N Babaa
(74) *Attorney, Agent, or Firm* — Merchant & Gould P.C.

(57) ABSTRACT

A plate heat exchanger without straight flow channels is provided, for exchanging heat between fluids. Said heat exchanger, comprises a start plate, an end plate and a number of heat exchanger plates provided with a pressed pattern of ridges and grooves with a pitch. The heat exchanger plates are kept at a distance from each other by contact between ridges and grooves of neighboring plates in contact points, when said plates are being stacked onto one another. Flow channels are thus formed between said plates, the contact points are positioned so that no straight lines are formed along the length of the heat exchanger plates.

7 Claims, 10 Drawing Sheets

(56) References Cited

U.S. PATENT DOCUMENTS

| | | | | |
|---|---|---|---|---|
| 2011/0139419 | A1 | 6/2011 | Blomgren | |
| 2012/0118548 | A1* | 5/2012 | Han | F28F 3/046 165/177 |
| 2012/0227438 | A1* | 9/2012 | Ito | F28D 9/005 62/498 |
| 2014/0196870 | A1 | 7/2014 | Rusich | |

FOREIGN PATENT DOCUMENTS

| | | | | | |
|---|---|---|---|---|---|
| GB | 1339542 | A | | 12/1973 | |
| JP | 54-85547 | | | 6/1979 | |
| JP | 4-73595 | | | 3/1992 | |
| JP | 9-89482 | | | 4/1997 | |
| JP | H09-89482 | A | | 4/1997 | |
| JP | 2000-247192 | A | | 12/2000 | |
| JP | 2000-337789 | A | | 12/2000 | |
| JP | 2002-107074 | A | | 4/2002 | |
| JP | 2010249432 | A | * | 11/2010 | F28F 3/046 |
| SE | 523581 | C2 | | 5/2004 | |
| WO | 86/05866 | A1 | | 10/1986 | |
| WO | 2011/073083 | A1 | | 6/2011 | |

OTHER PUBLICATIONS

Korean Office Action for Korean Application No. 10-2016-7014287 dated Nov. 6, 2020 (English Translation).
International Search Report for International Application No. PCT/EP2014/075957 dated Apr. 24, 2015 (3 pages).
English Translation of Office Action for Japanese Patent Application No. 2016-534662 dated Aug. 21, 2018.

* cited by examiner

HEAT EXCHANGING PLATE WITH VARYING PITCH

This application is a Continuation of U.S. application Ser. No. 15/101,568, filed 3 Jun. 2016, which is a National Stage Application of PCT/EP2014/075957, filed 28 Nov. 2014, which claims benefit of Serial No. 1351451-8, filed 5 Dec. 2013 in Sweden and which applications are incorporated herein by reference. To the extent appropriate, a claim of priority is made to each of the above disclosed applications.

FIELD OF THE INVENTION

1. The present invention relates to a plate heat exchanger for exchanging heat between fluids, comprising a start plate, an end plate and a number of heat exchanger plates, the heat exchanger plates being provided with a pressed pattern of ridges and grooves, said heat exchanger plates being kept at a distance from each other by contact between the ridges and grooves of neighboring plates in contact points when said plates are stacked onto one another.

PRIOR ART

Heat exchangers are used for exchanging heat between fluid media. They generally comprise a start plate, an end plate and a number of heat exchanger plates stacked onto one another in a manner forming flow channels between the heat exchanger plates. Usually, port openings are provided to allow selective fluid flow in and out from the flow channels in a way well known to persons skilled in the art.

A common way of manufacturing a plate heat exchanger is to braze the heat exchanger plates together to form the plate heat exchanger. Brazing a heat exchanger means that a number of heat exchanger plates are provided with a brazing material, after which the heat exchanger plates are stacked onto one another and placed in a furnace having a temperature sufficiently hot to melt the brazing material. The melting of the brazing material means that the brazing material (partly due to capillary forces) will concentrate in areas where the heat exchanger plates are in close vicinity of one another, such as in contact points between ridges and grooves of neighboring heat exchanger plates, and after the temperature of the furnace has been lowered, the brazing material will solidify, whereupon the heat exchanger plates will be joined to one another to form a compact and strong heat exchanger.

It is well known by persons skilled in the art that the flow channels between the heat exchanger plates of a plate heat exchanger are created by providing the heat exchanger plates with a pressed pattern of ridges and grooves. The distance between the ridges and grooves is generally referred to as pitch. A number of identical heat exchanger plates are typically stacked on one another, wherein every other heat exchanger plate is rotated 180 degrees as compared to its neighboring heat exchanger plates. When stacked, the ridges of a first of the heat exchanger plates contact the grooves of a neighboring heat exchanger plate and are thus kept at a distance from each other. Hence flow channels are formed. In these flow channels, fluid media, such as a first and second fluid media are lead so that heat transfer is obtained between such media.

A typical prior art heat exchanger is shown in FIG. 1. Here, the contact points between ridges R and grooves G of two neighboring heat exchanger plates P within prior art are positioned in a straight line along the length of the heat exchanger plates (see the dotted arrow). This gives a linear element to the flow channels of fluid media, which gives less efficient heat transfer.

In Swedish patent SE 523 581, a heat exchanger according to the prior art is shown. This heat exchanger comprises plates wherein the pitch of the pressed pattern close to port openings is smaller than a pitch of a main heat transfer area—as a result thereof, the contact points are provided at smaller mutual distances close to the port openings. The contact points of the main transfer area and in the vicinity of the port opening are, however, provided such that the contact points are distributed along straight lines running parallel to an axis of the heat exchanger.

GB 1 339 542 discloses a heat exchanger provided with gaskets. The heat exchanger plates are provided with turbulence inducing formations in form of corrugations. There is no mention in this document that the corrugations of neighbouring plates actually contact one another.

The object of the present invention is to provide a plate heat exchanger having an efficient heat transfer between the fluid media.

SUMMARY OF THE INVENTION

The present invention solves the above and other problems by providing a plate heat exchanger for exchanging heat between fluids, wherein the contact points between ridges and grooves of neighboring heat exchanger plates are positioned so that no straight lines are formed along the length of the heat exchanger plates.

In one embodiment of the invention, this is achieved by varying a pitch of the pressed pattern over the length of the heat exchanger plates, e.g. the pitch of the pressed pattern may be increasing over said length.

In one embodiment of the invention, the pitch of the pressed pattern is increasing according to a vernier scale.

In an embodiment of the invention the pitch of the pressed pattern is varying over a part of the length of the heat exchanger plates.

In an embodiment of the invention the ridges and grooves are distributed in groups defined by portions of ridges and grooves with smaller pitch, separated by portions with larger pitch.

In an embodiment of the invention the pitch of the pressed pattern is different in different parts of the length of the heat exchanger plates.

In an embodiment the ridges and grooves are arranged in a herringbone pattern. In another embodiment the ridges and grooves are arranged in a curved pattern. In yet another embodiment the ridges and grooves are arranged in a pattern with inclined straight lines.

In an embodiment of the invention neighboring heat exchanger plates are of different designs.

In an embodiment said heat exchanger plates are brazed together. An advantage with this is better stability of the heat exchanger.

BRIEF DESCRIPTION OF THE DRAWINGS

In the following, the invention will be described with reference to the appended drawings, wherein.

DESCRIPTION OF EMBODIMENTS

Figure 1:
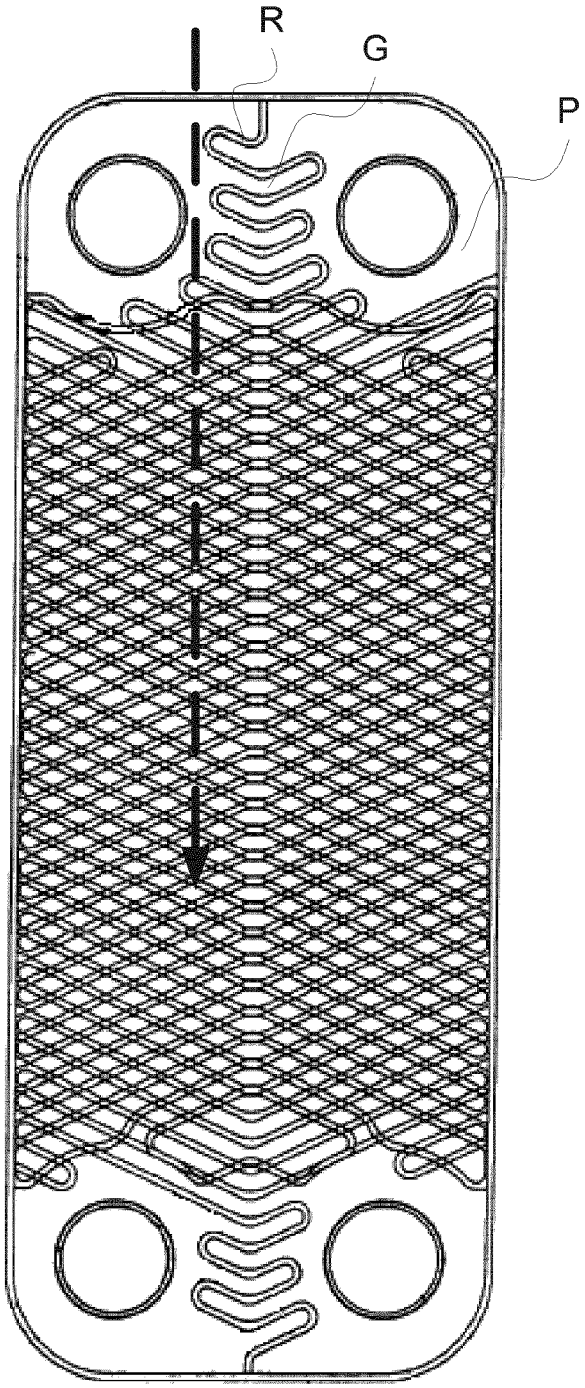
FIG. 1 is a schematic top view of two prior art heat exchanger plates.

An example of a prior art heat exchanger is seen in FIG. 1, described in the prior art chapter.

Figure 2A:
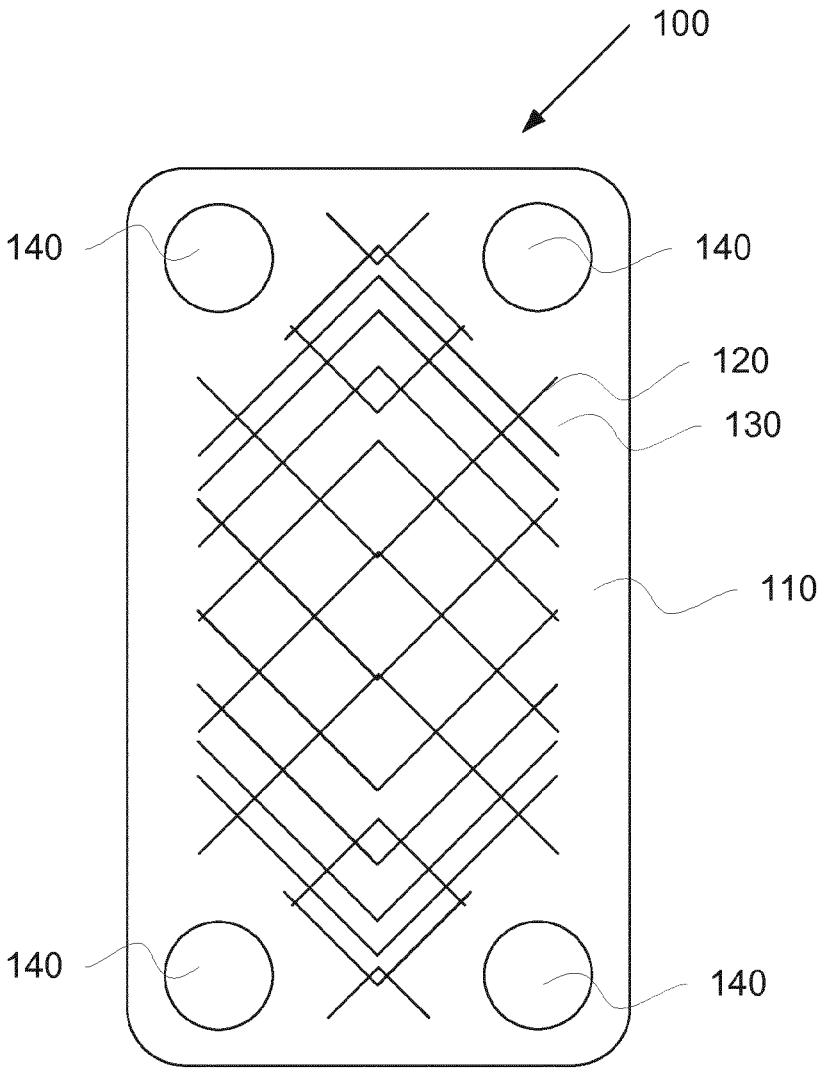
FIG. 2*a* is a schematic top view of two heat exchanger plates with a varying pitch of the pressed pattern of ridges and grooves.
Figure 2B:
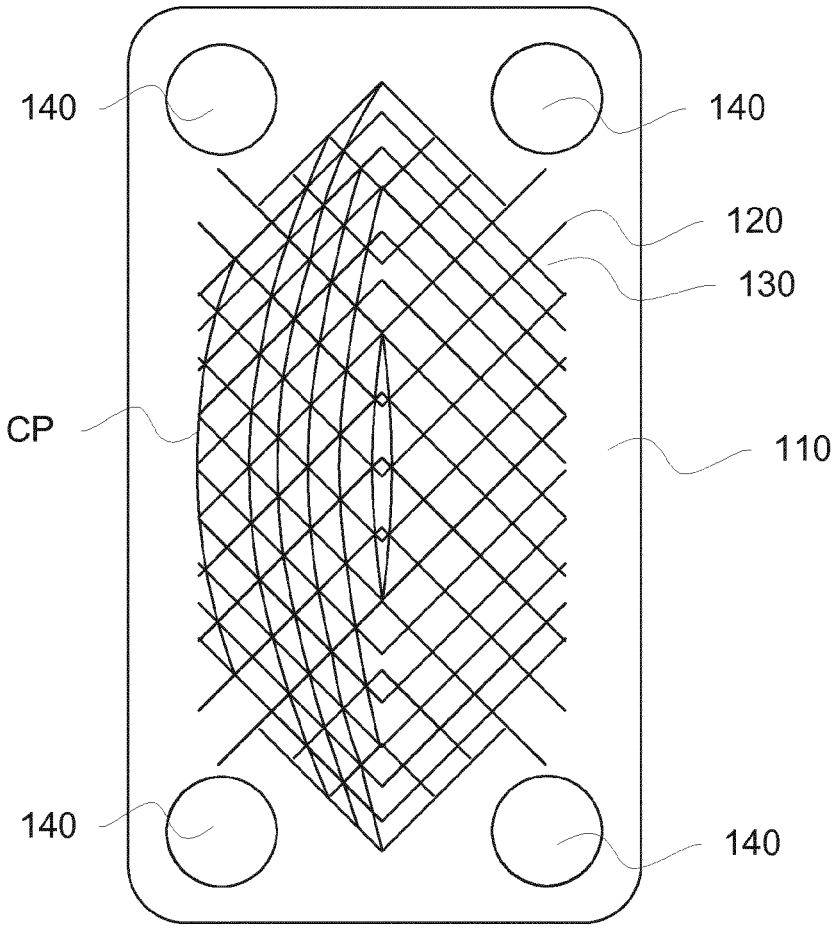
FIG. 2*b* is a schematic top view showing contact points between two heat exchanger plates comprised in the present invention.

In FIGS. 2*a* and 2*b*, two top views exhibiting a contact point pattern between two heat exchanger plates comprised in a heat exchanger 100 according to a first embodiment of the present invention are shown. The heat exchanger 100 comprises a number of heat exchanger plates 110, which each comprises a pressed herringbone pattern of ridges 120 and grooves 130, adapted to form flow channels between neighboring plates as the plates are stacked onto one another, wherein one plate has been rotated 180 degrees in its plane compared to its neighbours. The herringbone shape of the pressed pattern is necessary if identical plates are used for the heat exchanger. Moreover, the heat exchanger plates comprise port openings 140, being in fluid communication with the flow channels in a way well known to a person skilled in the art. The contact points between the ridges 120 and grooves 130 of neighboring heat exchanger plates are positioned so that no straight lines joining the contact points are formed along the length of the heat exchanger plates 110—se lines curved lines CP of FIG. 2*b*.

Figure 3A:
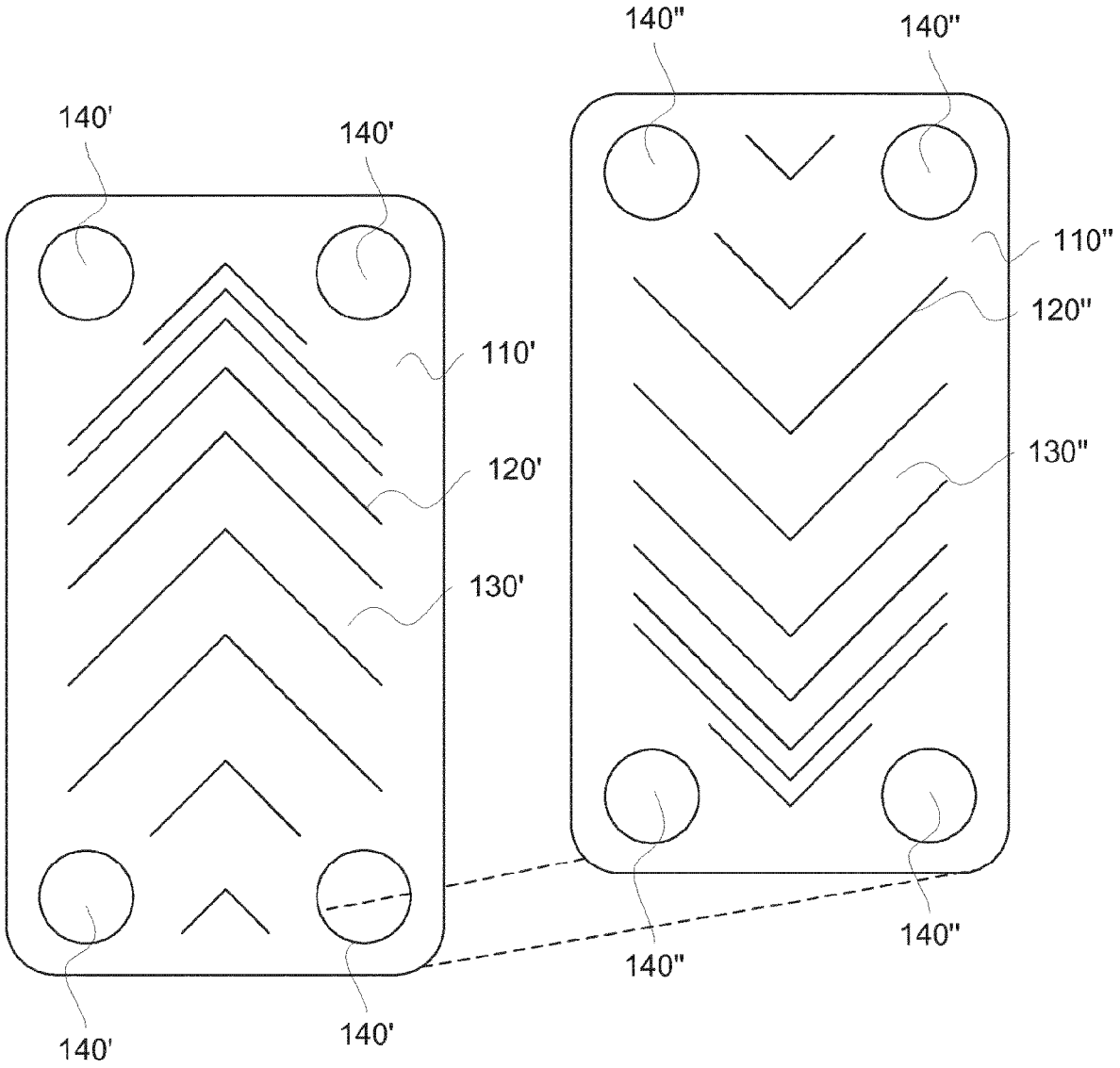
FIG. 3*a* is a schematic top view of two heat exchanger plates with varying pitch.
Figure 3B:
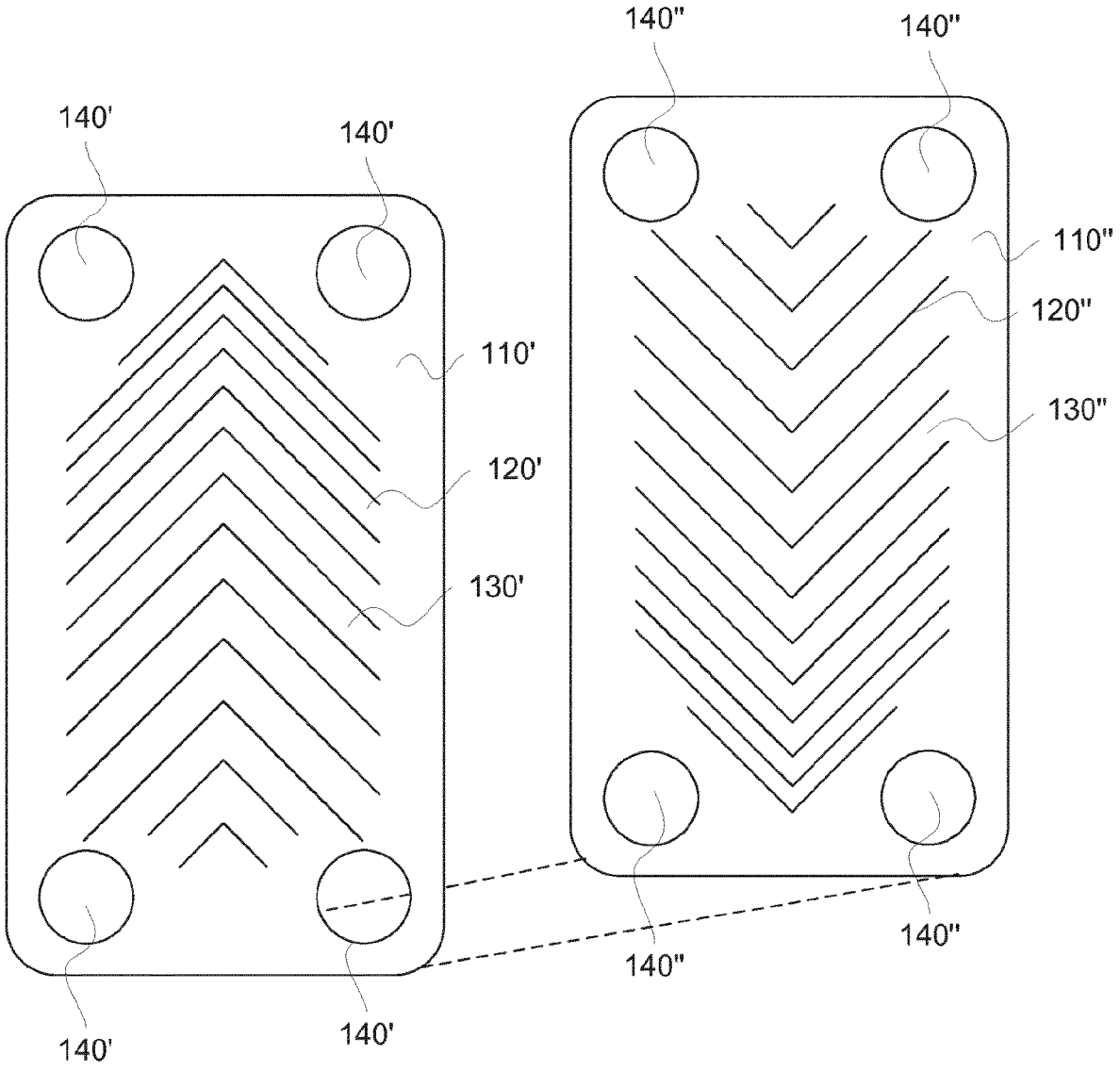
FIG. 3*b* is a schematic top view showing two heat exchanger plates wherein the pitch increases arithmetically over the length of the heat exchanger plates.

In FIGS. 3*a* and 3*b*, an embodiment exhibiting one heat exchanger plate 110' and one neighboring heat exchanger plate 110" is shown. The heat exchanger plate 110' is placed above the heat exchanger plate 110". The heat exchanger plates 110', 110" are provided with a pressed pattern of ridges 120', 120", respectively, and grooves 130', 130", respectively. The patterns of ridges and grooves are adapted to keep the heat exchanger plates on a distance from one another, by contact between ridges 120', 120" and grooves 130', 130" of the neighboring heat exchanger plates, when stacked onto one another. The port openings 140', 140" are provided on different heights, in a way well known by persons skilled in the art; by placing the port openings on various heights, it is possible to provide ports allowing fluid flow into one space delimited by a pair of heat exchanger plates, and sealing off fluid flow into other spaces delimited by another, often neighboring space delimited by heat exchanger plates 110', 110".

The resulting heat exchanger 100 will hence exhibit flow channels for the heat exchanging fluid held together by contact points between ridges and grooves, positioned such that straight flow through the flow channels is made impossible, i.e. heat exchanging channels where the first and second fluid media flow in a more turbulent fashion. In most cases, this is highly desired. However, the desired degree of turbulence created may vary from case to case.

An advantage with this is that the heat exchanging fluid is flowing in a more turbulent fashion, which gives a more efficient heat transfer.

Figure 4A:
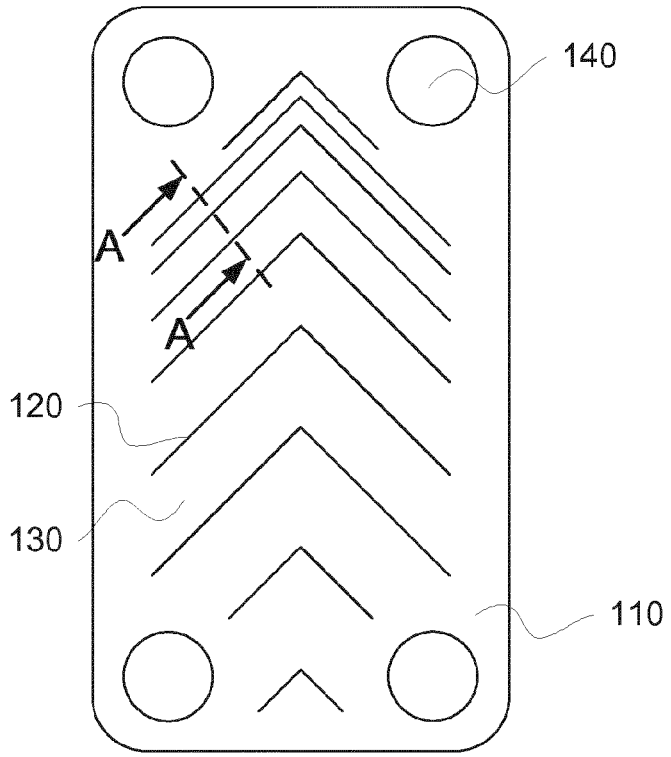
FIG. 4*a* is a schematic top view of a heat exchanger plate according to the present invention.
Figure 4B:
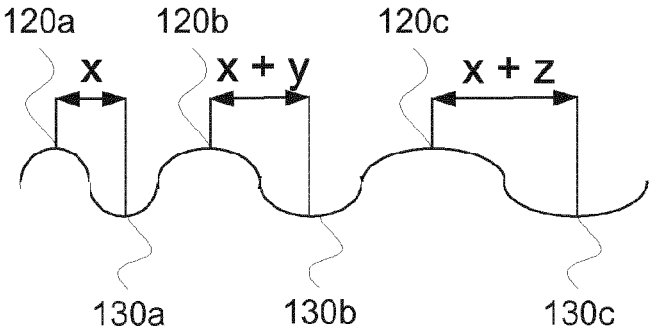
FIGS. 4*b* and 4*c* are section views taken along the line A-A of FIG. 4*a;*
Figure 4C:
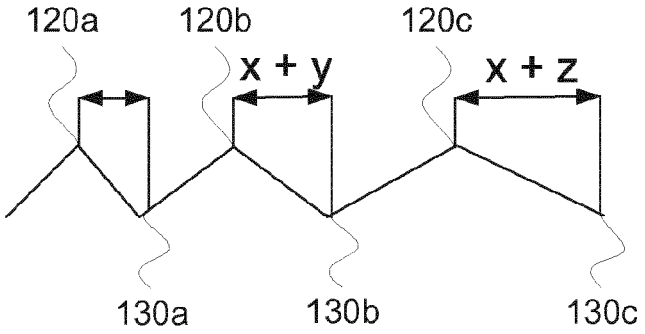

In FIGS. 4*a* and 4*b*, an embodiment exhibiting the non linearity more clearly is shown. In FIG. 4*a* arrows A-A indicate a section through the heat exchanger plate 110, which section is shown in FIG. 4*b*. A distance X of the smallest pitch between a ridge 120*a* and a groove 130*a* is less than the distance X+Y of the next pitch between a ridge 120*b* and a groove 130*b*, which in turn is less than the distance X+Z of the following pitch between a ridge 120*c* and a groove 130*c*. When combining two heat exchanger plates 110, turned 180 degrees in relation to each other, the contact points between the ridges 120 and grooves 130 of neighboring heat exchanger plates are positioned so that no straight lines are formed along the length of the heat exchanger plates 110.

Figure 5A:
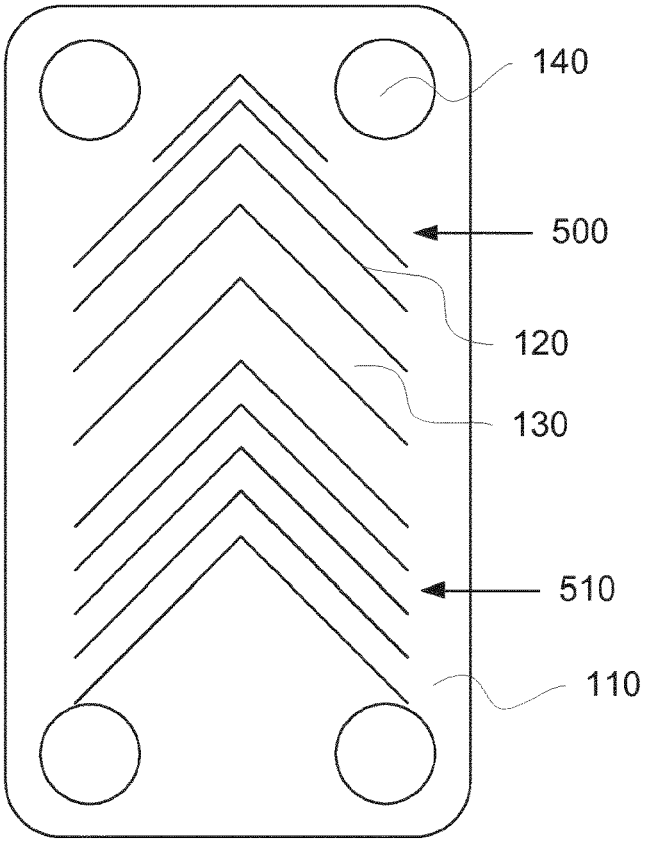
FIG. 5*a* is a schematic top view of a heat exchanger plate with partly varying pitch and a herringbone pattern of ridges and grooves.
Figure 5B:
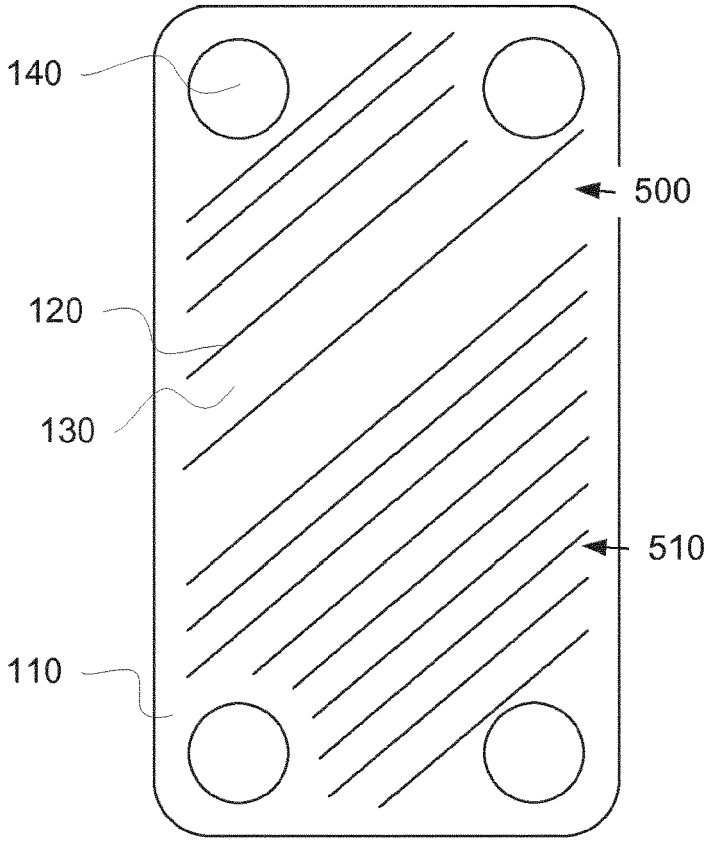
FIG. 5*b* is a schematic top view of a heat exchanger plate with partly varying pitch and a pattern of straight inclined ridges and grooves.

In FIGS. 5*a* and 5*b*, an embodiment exhibiting the pitch of the pressed pattern of the heat exchanger plate 110 varying over a first part 500 of the length of the heat exchanger plate 110, while being constant over a second part 510 of the length of the heat exchanger plate 110 is shown. The length of the heat exchanger plate 110 may also be divided in more than two parts, with alternating varying and constant pitch. The length of the heat exchanger plate 110 may be subdivided into parts with alternating varying and constant pitch according to any ratio suitable, such as 50/50, 70/30, 30/70, 33/33/33, 25/25/50 etc.

Figure 6A:
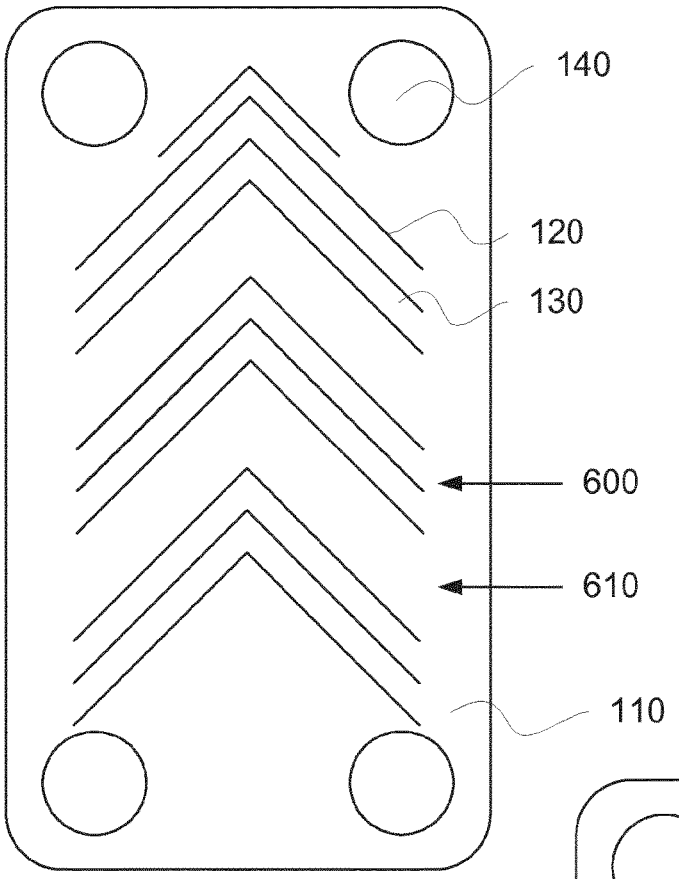
FIG. 6*a* is a schematic top view of a heat exchanger plate with partly grouped herringbone pattern of ridges and grooves.
Figure 6B:
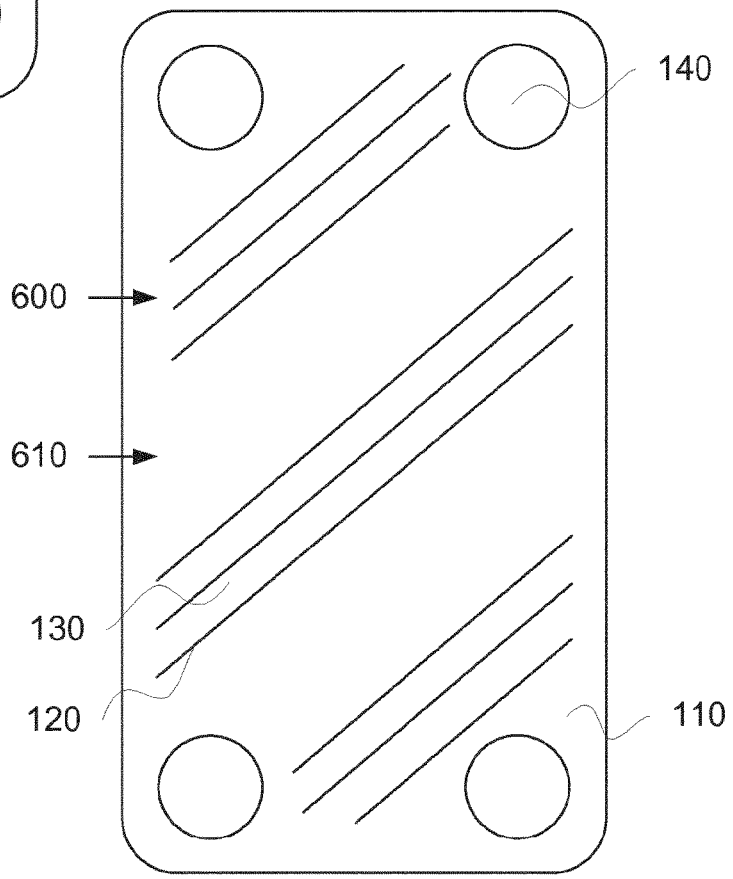
FIG. 6*b* is a schematic top view of a heat exchanger plate with partly grouped pattern of straight inclined ridges and grooves.

In an embodiment according to FIGS. 6*a* and 6*b*, the ridges and grooves are distributed in groups defined by portions of ridges and grooves with smaller pitch 600, separated by portions with larger pitch 610. Any number of ridges and grooves may be used in the groups defined by portions of ridges and grooves with smaller pitch 600, such as 2, 3, 4, 5, 6, 7, 8 ridges and grooves.

Figure 7A:
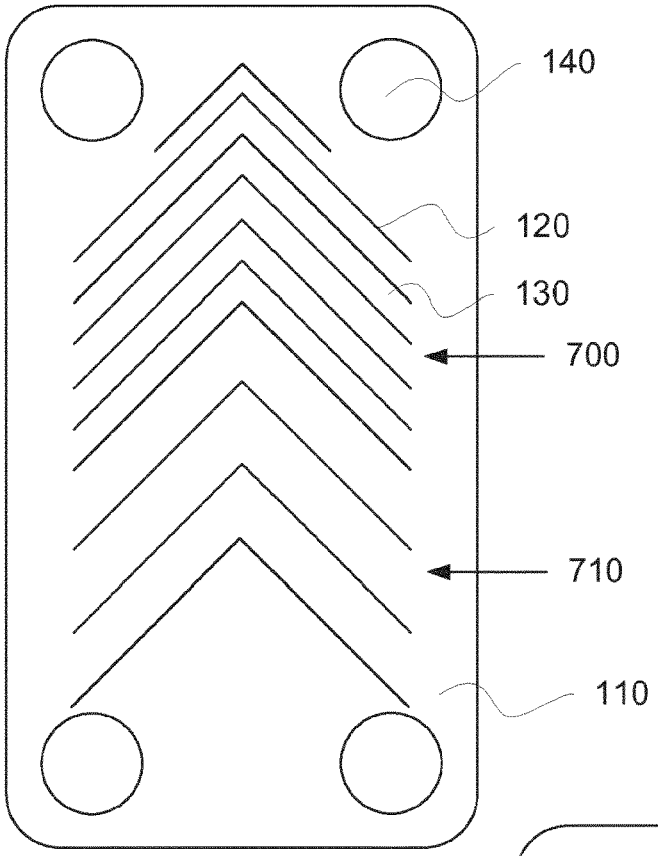
FIG. 7*a* is a schematic top view of a heat exchanger plate with different pitch of herringbone shaped ridges and grooves in different parts of the length of the heat exchanger plates.
Figure 7B:
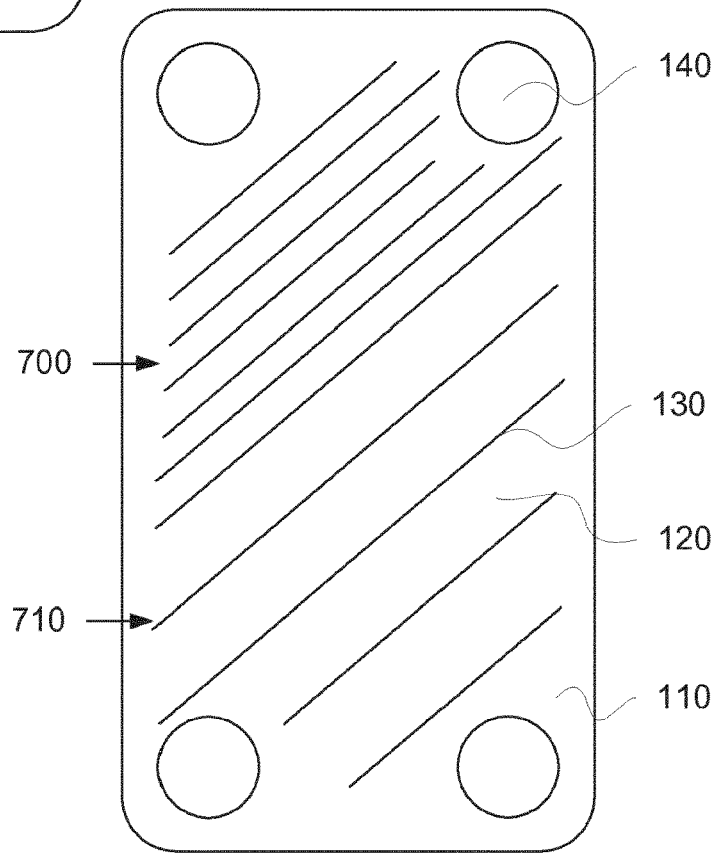
FIG. 7*b* is a schematic top view of a heat exchanger plate with different pitch of straight inclined ridges and grooves in different parts of the length of the heat exchanger plates.

In FIGS. 7*a* and 7*b*, an embodiment exhibiting the pitch of the pressed pattern of the heat exchanger plate 110, constant over a first part 700 of the length of the heat exchanger plate 110 and different over a second part 710 of the length of the heat exchanger plate 110, is shown. The length of the heat exchanger plate 110 may also be divided into more than two parts, with pitches of different value. The length of the heat exchanger plate 110 may be subdivided into parts according to the embodiment shown in FIGS. 5*a* and 5*b*.

Figure 8A:
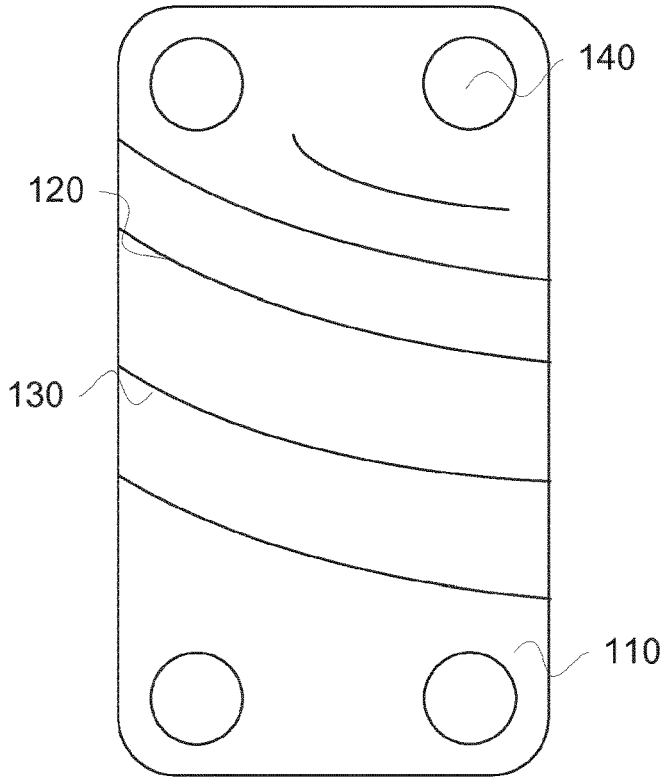
FIGS. 8*a* and 8*b* are schematic top views of heat exchanger plates with curved pattern of ridges and grooves.
Figure 8B:
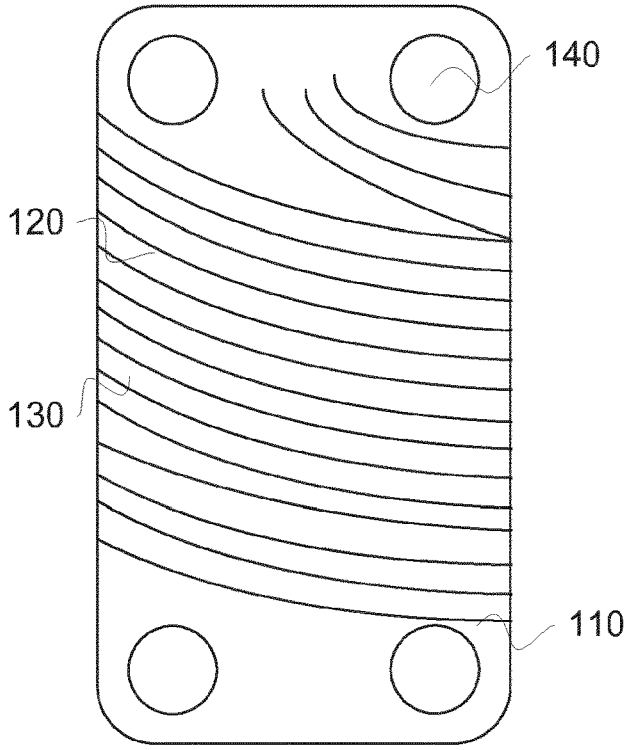

Different patterns of the ridges and grooves may be used to keep the heat exchanger plates at a distance from each other when the ridges and grooves of neighboring heat exchanger plates interact in contact points, when said heat exchanger plates are being stacked onto one another so that the contact points are positioned so that no straight flow channels are formed. In the embodiments according to FIG. 5*a*, FIG. 6*a* and FIG. 7*a*, a herringbone pattern is used. In the embodiments according to FIG. 5*b*, FIG. 6*b* and FIG. 7*b*, a pattern with inclined straight lines is used. In further embodiments according to FIGS. 8*a* and 8*b*, a curved pattern is used. Any possible combination of distances between the ridges and grooves or any possible grouping or distribution of ridges and grooves may be used in combination with any pattern, as long as the contact points obtained when stacking the heat exchanger plates, with or without rotating them 180 degrees, are positioned so that no straight flow channels are formed.

The heat exchanger plates may be fixed to each other by any means known to a person skilled in the art, such as brazing, pressing, etc.

The present invention can be varied significantly without departing from the scope of invention, such as it is defined in the appended claims.

The invention claimed is:

1. A plate heat exchanger for exchanging heat between fluids, comprising:

(a) a start plate, an end plate, and a number of heat exchanger plates arranged between the start plate and the end plate, the heat exchanger plates being provided with a pressed pattern of ridges and grooves, wherein the heat exchanger plates include a first pair of port openings, a second pair of port openings, and a length extending from the first pair of port openings to the second pair of port openings, and forming flow channels between neighboring heat exchanger plates such that flow in the channels is from one of the first pair of port openings to one of the second pair of port openings or vice versa;

(b) the pressed pattern of ridges and grooves are arranged in an inclined straight pattern or a curved pattern, wherein a pitch of the pressed pattern of ridges and grooves varies over the length of the heat exchanger plates forming a varied pitch extending from the first pair of port openings to the second pair of port openings, and wherein the pitch is a distance along a plane parallel to the heat exchanger plates between adjacent ridges and grooves; and (c) said heat exchanger plates form contact points between the pressed pattern of ridges and grooves of neighboring heat exchanger plates, wherein the contact points between the pressed pattern of ridges and grooves of neighboring heat exchanger plates form a curve in a plane parallel to the heat exchanger plates and through the contact points, and wherein the curve results from the varied pitch of the pressed pattern of ridges and grooves, wherein the contact points along the length of the heat exchanger plates provide that the flow channels are not straight.

2. The heat exchanger of claim 1, wherein the varied pitch of the pressed pattern increases over said length.

3. The heat exchanger of claim 2, wherein the varied pitch of the pressed pattern increases according to an arithmetic series.

4. The heat exchanger of claim 1, wherein the ridges and grooves are distributed in groups defined by portions of ridges and grooves with smaller pitch, separated by portions with larger pitch.

5. The heat exchanger of claim 1, wherein the varied pitch of the ridges and grooves of the pressed pattern is different in different parts over the length of the heat exchanger plates.

6. The heat exchanger of claim 1, wherein the pressed pattern of ridges and grooves extending between the first pair of port openings and the second pair of port openings is provided as only the inclined straight pattern.

7. The heat exchanger of claim 1, wherein the pressed pattern of ridges and grooves extending between the first pair of port openings and the second pair of port openings is provided as only the curved pattern.

* * * * *